US008033876B2

(12) United States Patent
Davis et al.

(10) Patent No.: US 8,033,876 B2
(45) Date of Patent: Oct. 11, 2011

(54) CONNECTOR PIN AND METHOD

(75) Inventors: Donald R. Davis, Brighton, MI (US); Nicolaus A Radford, Houston, TX (US); R. Scott Askew, Houston, TX (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 12/706,744

(22) Filed: Feb. 17, 2010

(65) Prior Publication Data

US 2010/0279524 A1 Nov. 4, 2010

Related U.S. Application Data

(60) Provisional application No. 61/174,316, filed on Apr. 30, 2009.

(51) Int. Cl.
*H01R 13/05* (2006.01)

(52) U.S. Cl. ..... 439/825; 439/839

(58) Field of Classification Search ..... 439/825, 439/592, 839, 593, 86

See application file for complete search history.

(56) References Cited

U.S. PATENT DOCUMENTS 2,502,634 A * 4/1950 Smith ..... 439/592
3,845,459 A * 10/1974 Normann ..... 439/381
5,993,253 A * 11/1999 Sai ..... 439/578

* cited by examiner

*Primary Examiner* — Javaid Nasri
(74) *Attorney, Agent, or Firm* — Quinn Law Group, PLLC

(57) ABSTRACT

An electrical connector and method includes a connector and a conforming element proximate to or in contact with the mating end of the connector so as to prevent distortion of a matable end. The matable end of the connector may be of a female or male type and may be of a post, tube, blade, pin, or other configuration. An element made of conforming material, for example, an elastomer, epoxy or rubber type material, is configured and positioned in contact with the matable end of the connector, providing support during assembly to prevent distortion of the matable end. The conforming element may be rectangular, wedge, cylindrical, conical, annular, or of another configuration as required to provide support to the connector pin. The conforming element may be fastened with an adhesive to the matable end to further prevent distortion.

20 Claims, 3 Drawing Sheets

CONNECTOR PIN AND METHOD

CROSS-REFERENCE TO RELATED APPLICATIONS

The present application claims the benefit of and priority to U.S. Provisional Application No. 61/174,316 filed on Apr. 30, 2009.

STATEMENT REGARDING FEDERALLY SPONSORED RESEARCH OR DEVELOPMENT

This invention was made with government support under NASA Space Act Agreement number SAA-AT-07-003. The government may have certain rights in the invention.

TECHNICAL FIELD

The present invention relates to electrical connectors, specifically connector pins, also known as terminals or terminal pins.

BACKGROUND OF THE INVENTION

Electrical connectors of varying configurations may be used where blind mate insertion is required, for example in space constrained environments such as robot arms or fingers. During blind mate insertion, or insertion without visual assistance, distortion of the connector pins may occur from misalignment of the pins of one connector with the pins of the mating connector, and with the resulting physical interference preventing a successful electrical connection. This distortion may include bending of mating ends of the connector pin, bending of a portion of the connector pin from its central axis, collapse of the mating pin end or distortion of a flexible element of the pin mating end.

In applications which require numerous connections and disconnections of the connector, distortion of the connector pins may be cumulative, causing decreasing function and failure over time. In some applications, distortion may occur after assembly if the connectors are subject to certain detrimental conditions of use. Detrimental conditions of use may include, by example, excessive vibration, physical loading, thermal stressing, repetitive stressing, as in a push-pull or repetitive motion environment, for example as in a robot arm or manipulator, improper assembly, assembly without jack screws, or assembly with incomplete connection of other connector retention features.

Distortion of connector pins may render the connector unusable, resulting in, for example, unacceptable connector life, repair and replacement costs, loss of operating capability, decreased reliability and compromised integrity of the electrical connection. Existing solutions to prevent connector pin distortion are not adaptable to all operating environments. For example, alignment features added to the connector housing, or retention features such as secondary clips and tangs, may not be feasible in some applications where space constraints prohibit the larger housing size required for incorporating these features. An alternative solution to prevent distortion that is integral to or incorporated into the connector pin is advantageous to improving connector reliability in space constrained applications.

SUMMARY OF THE INVENTION

It is an object of the present invention to increase the durability of a connector pin, by improving the resistance of the connector pin to distortion upon insertion into a mating connector, including blind mate insertion of the type that may be required in a space constrained environment, such as, for example, a robot arm. An electrical connector is provided that is configurable for assembly to a mating electrical connector, including a connector housing with one or more connector pins. Each connector pin has a mating end of a female or male type. The connector pin may be of various configurations, for example, post, tube, blade, pin, or other configurations known by those of ordinary skill in the art.

An element made of conforming material, for example, an elastomer, epoxy or rubber type material, is incorporated into the connector pin such that the conforming element is in sufficient contact with the mating end of the connector pin, to provide support during assembly so as to prevent distortion of the mating end. The configuration of the conforming element may be rectangular, wedge, cylindrical, conical, annular, or of an alternate configuration as required to provide support to the particular configuration of the connector pin and the connector housing. The conforming element may be inserted into the interior of the mating end of the pin to provide a supportive element preventing distortion of the mating end during assembly. Alternatively, the conforming element may surround a portion of the exterior surface of the mating end to constrain the exterior surface and to prevent distortion during assembly. To ensure retention of the conforming element, and/or as a method of providing additional support to prevent distortion, an adhesive may be used to position and adhere the conforming element to the mating end of the connector pin.

The conforming element may be incorporated in the connector pin to form a connector pin assembly, prior to assembly of the connector pin into a connector housing. Alternatively, the conforming element may be incorporated in the connector pin after the connector pin has been assembled into a connector housing.

The conforming element provides support to the mating end of the connector pin to prevent distortion of the connector pin during assembly to the mating connector. Further, it improves the durability of the connector pin by increasing the pin's resistance to distortion during multiple disconnections and reconnections of the connector pin, and by increasing the resistance of the pin to distortion from other conditions of use such as, for example, misassembly, vibration, physical loading, thermal stressing, exposure to push-pull stressing or a repetitive motion environment, for example as in a robot arm or robot fingers. The present invention provides the benefits of improved connector pin durability, extended connector life, reduced costs of repair and maintenance, reduced equipment downtime and improved integrity of electrical connections.

The claimed invention is adaptable to many different types of electrical connector pins and connector housing combinations, and may be used in conjunction with other connector alignment and retention features. The above features and advantages and other features and advantages of the present invention are readily apparent from the following detailed description of the best modes for carrying out the invention when taken in connection with the accompanying drawings.

DESCRIPTION OF THE PREFERRED EMBODIMENT

Figure 1A:
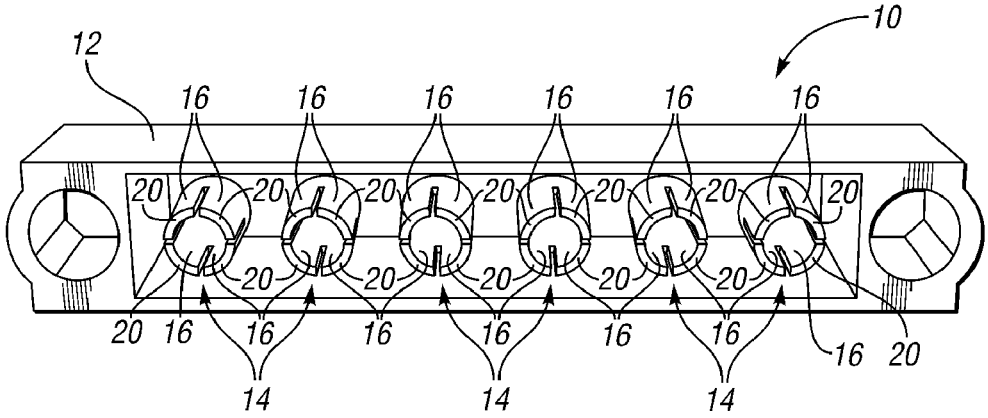
FIG. 1A is schematic perspective view illustration of a connector.
Figure 1B:
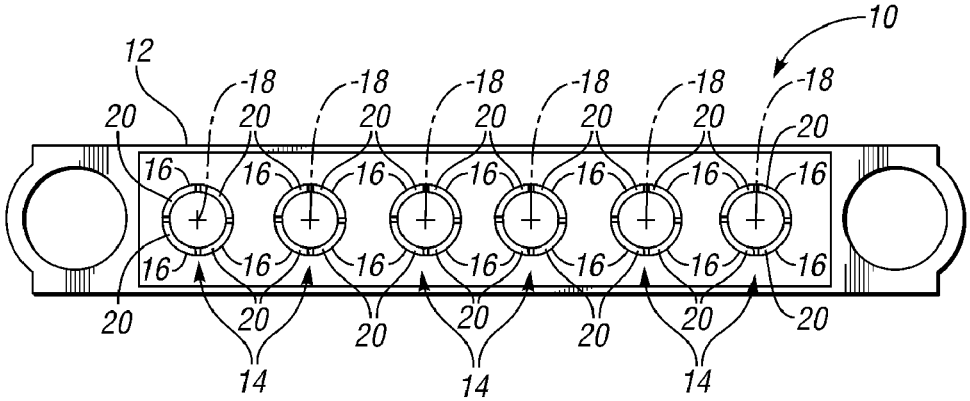
FIG. 1B is a schematic plan view representation of the connector of FIG. 1A.
Figure 1C:
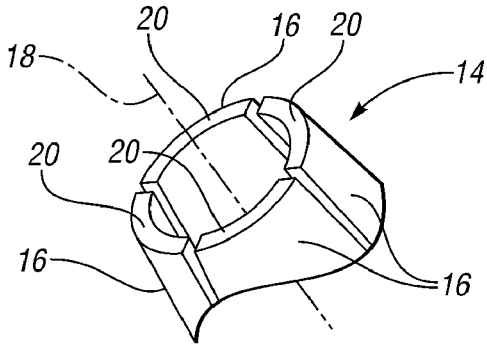
FIG. 1C is a fragmentary schematic illustration of the end of a connector pin of the connector shown in FIGS. 1A and 1B.

With reference to the drawings, wherein like reference numbers refer to the same or similar components throughout the several views, and beginning with FIG. 1A, provided is a connector assembly generally indicated at 10. Electrical connector assembly 10 includes a connector housing 12 and connector pins 14. Connector pin 14, and similar connector pins shown throughout the several figures, may also be referred to as a connector post, connector end, terminal, terminal end, terminal pin, pin, post or by other terminology familiar to those skilled in the art. Connector pin 14 includes flexible sections or members 16, which may be referred to as matable tangs or extensions. The matable tangs 16 are configured to mate with or assemble to an end of a mating connector pin (not shown) to establish an electrical connection. As shown in FIGS. 1B and 1C, the respective flexible members 16 and respective matable ends 20 of each connector pin 14 are in radial alignment with the respective axis 18 of the respective connector pin 14, as required for proper assembly of each connector pin 14 to a mating connector pin (not shown).

Connector assembly 10 may be used in any application where establishing an electrical connection using a connector is desired. As an example, and without limiting the claimed invention, the connector assembly 10 may be used in a robot, to provide electrical connection to an arm or to fingers of the robot. In applications such as an arm or fingers of a robot, the connector assembly 10 and connector pins 14 may be positioned in a space constrained environment requiring blind mate insertions into a mating connector, and/or assembly without secondary retention devices, such as jack screws or retention tangs. Additionally, in an application such as an arm or fingers of a robot, the connector assembly 10 and connector pins 14 may be subjected to repeated disconnection and reconnection for service and adjustment, and repeated cyclical loading and exposure to push-pull stressing from a repetitive motion duty cycle, imposing distortive stresses to the connector assembly 10 and connector pins 14.

During assembly of connector assembly 10, the mating ends 20 of the tangs 16 of a connector pin 14 may be misaligned with the mating ends of a mating connector, causing an interfering condition which may result in deflection and distortion of one or more of the tangs 16 on one or more of the connector pins 14. Misalignment may be, for example, from blind insertion. Other factors contributing to misalignment may include, as an example, assembly in a space constrained environment where use of jack screws or other retention clips may not be feasible, or where space constraints prevent optimal alignment of the connector mating ends 20 and axes 18 of connector pins 14 with their like parts in the mating connector assembly prior to insertion.

Tangs 16 may distort or deflect in any of a number of configurations. Referring to FIG. 1C, the connector 14 includes four tangs 16. Each tang 16 has a surface 20 at its mating end which is contacted with a mating connector during assembly. As shown in FIGS. 1B and 1C, the tangs 16 and surfaces 20 are generally oriented coincident with the circumference of a circle, where the center of the circle coincides with the central axis 18 of connector pin 16. In a non-deflected condition, the tangs 14 are spaced equally about the circumference of the circle. After interference or misalignment with a mating connector, or other source of contact resulting in damage, a tang 16 may be in a deflected or distorted condition. The deflected or distorted condition may be, for example, a tang 16 bent to overlap an adjacent tang 16. A tang 16 may be deflected radially inwardly or outwardly from a central axis 18 so that surface 20 no longer coincides with the circumference of a circle defined by the surfaces 20 of the non-distorted tangs 16. A tang 16 may be twisted or contorted sufficiently to misalign circumferentially so as to contact an adjacent tang 16. Other configurations, including misalignment radially and circumferentially, are possible and understood by those skilled in the art.

Some amount of deflection of the tangs 16 at mating ends 20 may be anticipated and tolerated during proper assembly. Referring to FIG. 1C, the tangs 16 of connector pin 14 may be radially deflected and compressed by the mating connector during insertion. When this deflection and compression occurs within the elastic range of connector pin material, the tangs 16 will radially expand to revert to a pre-compressed condition after insertion, unless constrained by contact with the mating connector. In this manner, the constrained contact of tangs 16 against the surface of the mating connector may be useful in establishing the electrical connection and maintaining the integrity of the electrical connection during use, including use when the connector pin 14 may be subject to repeated cyclical loading and exposure to vibration and/or push-pull stressing from a repetitive motion duty cycle.

When the amount of deflection of one or more of the tangs 16 of a connector pin 14 is significant, e.g., resulting in plastic deformation or permanent deflection of one or more of the tangs 16 due to misalignment and interference with the mating connector during an assembly attempt or as a result of mishandling or other damage, a number of conditions may result. When distortion of tangs 16 is significant enough to prevent the assembly of connector assembly 10 with a mating connector assembly, replacement of the damaged connector pin 14 or the entire connector assembly 10 may be required. This condition requires rework, repair or replacement of the connector assembly 10 and results in downtime, lost productivity and increased costs.

When distortion of connector pin 14 is significant, e.g., plastic deformation and permanent deflection of tangs 16 occur; it may be possible to assemble the connector assembly 10 to the mating connector assembly. In this second condition, the resulting electrical connection may lack electrical integrity in one or more circuits or have decreased reliability, e.g., may be more susceptible to electrical variability under certain operating conditions including vibration and push-pull stress conditions.

The electrical connection may fail qualification testing and replacement of the damaged connector pin 14 or the connector assembly 10 may be required. Again, this condition requires rework, repair or replacement of the connector assembly 10 and results in downtime, lost productivity and increased costs.

In a third condition, the distortion of tangs 16 may not be significant enough to prevent the assembly of connector assembly 10 with a mating connector assembly, or to cause failure of the electrical connection during initial qualification testing, and the somewhat distorted connector assembly may be put into use in a functional application. However, the distortion of connector pin 14 may result in decreased electrical integrity in one or more circuits after the connector assembly 10 is put to use, or decreased reliability over time, e.g., the electrical connection may be more susceptible to electrical variability under certain operating conditions including vibration and push-pull stress conditions. This condition may result in downtime, warranty costs and rework, repair or replacement of the connector 10. Distortion and deflection of the tangs 16 of connectors 14 may be cumulative, for example, as the result of multiple disconnections and reconnections of the connector during use or service, or as the result of stresses on the connector 14 while assembled, due to vibration, thermal or mechanical stressing of the connector assembly 10. The distortion may accumulate to a magnitude where the integrity of the electrical connection of pin 14 is compromised and the connector assembly 10 fails.

Figure 2A:
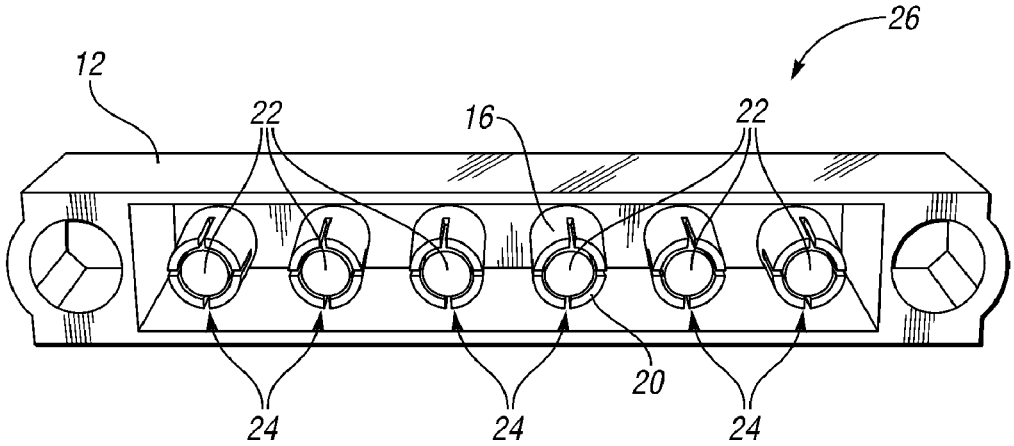
FIG. 2A is schematic perspective view illustration of a connector with conforming material inserts in the connector pins.
Figure 2B:
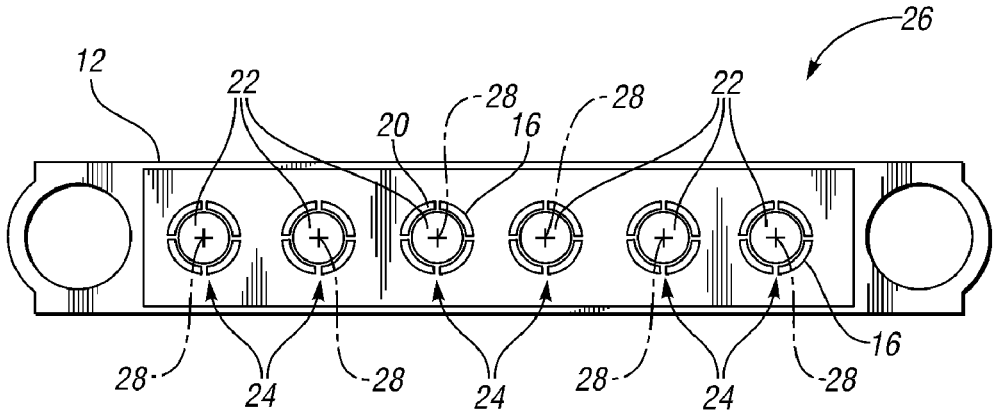
FIG. 2B is a schematic plan view representation of the connector of FIG. 1A, with conforming material inserts in the connector pins.
Figure 2C:
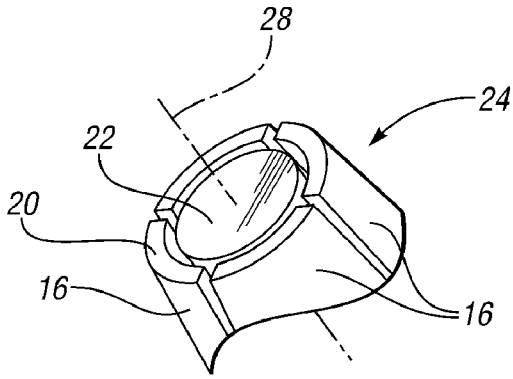
FIG. 2C is a fragmentary schematic illustration of the end of a connector pin of the connector shown in FIGS. 2A and 2B, with a conforming material insert.

Referring to FIG. 2A, there is shown a connector assembly of the claimed invention generally indicated at 26. Connector assembly 26 includes a connector housing 12 and connector pins 24 including conforming elements 22. FIG. 2B depicts a schematic illustration of the connector 26 of FIG. 2A, again showing a connector housing 12, connector pins 24 and conforming elements 22. FIG. 2C shows an embodiment of the mating end of connector pin 24, including the conforming element 22 of the claimed invention. The respective flexible members 16 and mating end 20 of each connector pin 24 are in radial alignment with the respective axis 28 of the respective connector pin 24, as required for proper assembly of connector pins 24 to mating connector pins (not shown), and each connector pin 24 is supported in this radially-aligned position by a conforming element 22. In this embodiment, conforming element 22 is configured as a cylindrically shaped element inserted into the hollow cylindrical interior of connector pin 24, proximate to or in contact with the interior surfaces of flexible members 16. Other configurations of conforming element 22 may also be used, for example, a spherical or conical element, as best suited to the mating application, to be positioned proximate to or in sufficient contact with connector pin 24 so as to provide support to and prevent distortion of the flexible members 16 and mating end 20 of connector pin 24 during insertion for assembly.

Conforming element 22 may be made of a conforming material providing the desired supportive and functional properties, for example, elastomeric materials, plastic, epoxy based materials and rubber or rubber based materials, or similar material known to those skilled in the art, to prevent distortion and/or plastic deformation of the mating end of connector 14. The selection of conforming material may also be influenced by other requirements of the application, such as, for example, operating temperature, electrical conductivity, bonding characteristics, formability, elasticity and durometer. In the present invention, conforming element 22 is made of a rubber based material.

Additionally, conforming element 22 may be adhered to connector pin 24 with an adhesive (not shown) to improve retention of conforming element 22 in proper position for conforming element 22 to provide support to flexible members 16 and mating ends 20. The adhesive may be applied, for example, between the external surface of conforming element 22 and the internal surfaces of flexible members 16, in the areas where the conforming element 22 contacts the internal surfaces of flexible members 16. The adhesive may also contribute to provide support to the flexible members 16 and mating ends 20 to prevent distortion thereof. The adhesive may be, by example, of a silicone or epoxy type, or similar material known to those skilled in the art. The selection of adhesive material may also be influenced by other requirements of the application, such as, for example, operating temperature, electrical conductivity, bonding characteristics, elasticity and strength. The adhesive in the present invention is of a silicone RTV type.

The application of the present invention is not limited to a specific type of connector assembly, connector housing or connector pin. Conforming elements can be configured in various shapes and of various materials to be suitable for use with various types of connector pins, including, by example, female and male connector pins, and hollow and solid connector pins. The conforming element may be incorporated in the connector pin to form a connector pin assembly, prior to assembly of the connector pin into a connector housing. Alternatively, the conforming element may be incorporated in the connector pin after the connector pin has been assembled into a connector housing. Further, the conforming element may be incorporated in the connector pin after the connector pin has been assembled into a connector housing, and after the connector assembly has been incorporated into a larger assembly, as a repair method or durability enhancement feature.

Figure 3A:
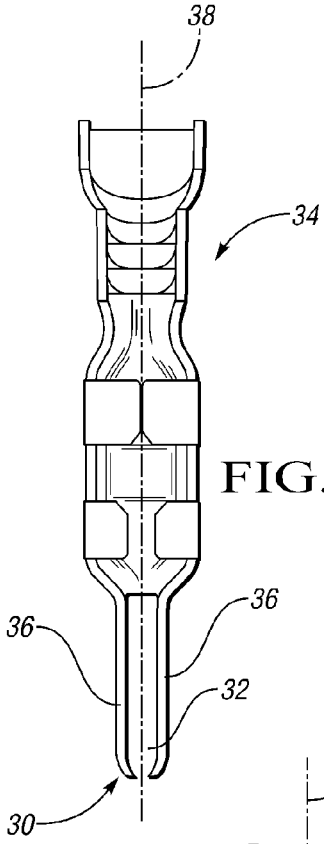
FIG. 3A is a partially cross-sectioned illustration of another connector pin.

Referring to FIG. 3A, a connector pin is generally indicated at 34. Connector pin 34 is of a male type, for example, a blade type connector, and includes flexible members 36 and mating ends 30 separated by a space 32. Connector pin 34 is shown in a non-distorted condition, where flexible members 36 and the mating ends 30 of connector pin 34 are in alignment with axis 38 of connector pin 34, as required for proper assembly of connector pin 34 to a mating connector pin, which may be, for example, a connector pin of the configuration shown in FIG. 4A.

Figure 4A:
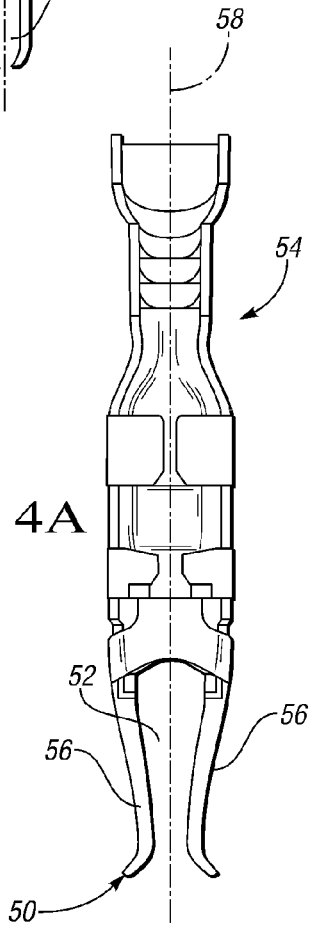
FIG. 4A is a partially cross-sectioned illustration of yet another connector pin, without distortion.

Flexible members 36 may become distorted and out of alignment from axis 38 of connector pin 34 as the result of improper alignment and/or interference upon insertion of connector pin 34 in a mating female connector pin, for example during insertion into the tangs 56 of connector pin 54 shown in FIG. 4A, upon repeated disconnection and connection of connector pin 34 from a mating connector pin or, by example, due to handling damage or distortion during assembly into a connector housing. The distortion may be of sufficient magnitude to prevent proper insertion of connector pin 34 into a matable female connector pin, preventing proper assembly and the making of a proper electrical connection.

Figure 3B:
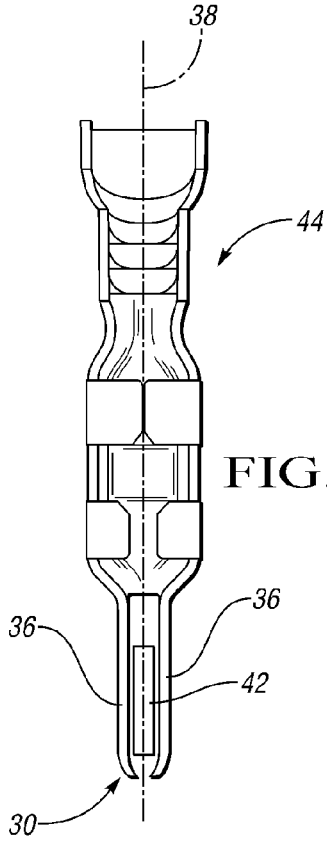
FIG. 3B is a partially cross-sectioned illustration of the connector pin of FIG. 3A, with a conforming element.

Referring to FIG. 3B, according to another embodiment of the connector pin 34, the conforming element 42 may be configured to be positioned in space 32 between the flexible members 36 of connector pin 34, proximate to or in contact with the interior surfaces of flexible members 36. Other configurations of conforming element 42 may also be used, for example, a rectangular, triangular, hexagonal, wedge, cylindrical, spherical, conical or other polygonal element, as best suited to the mating application, to be positioned proximate to or in sufficient contact with the interior surfaces of tangs 36 of connector pin 34 so as to provide support to and prevent distortion and plastic deformation of flexible members 36 and mating ends 30 of connector pin 34.

As discussed for the conforming element 22 in the embodiment shown in FIG. 2C, conforming element 42 may be made of a conforming material providing the desired supportive and functional properties, for example, elastomeric materials, plastic, epoxy based materials and rubber or rubber based materials. Conforming element 42 may be incorporated in connector pin 34 during the fabrication of connector pin 34, to form a connector pin assembly 44. Alternatively, conforming element 42 may be incorporated in the connector pin after connector pin 34 has been fabricated, by insertion or injection into space 32 of connector pin 34.

Also discussed previously, conforming element 42 may be adhered to connector pin 34 with an adhesive (not shown) to improve retention of conforming element 42 in proper position for conforming element 42 to provide support to flexible members 36 and mating end 30. The adhesive may be applied, for example, between one or more external surfaces of conforming element 42 and the internal surfaces of flexible members 36, in the areas where the conforming element 42 contacts the internal surfaces of flexible members 36. The adhesive may also contribute to provide support to the flexible members 36 and mating ends 30 to prevent distortion thereof. The adhesive may be, by example, of a silicone or epoxy type, or similar material known to those skilled in the art.

Referring to FIG. 4A, a connector pin is generally indicated at 54. Connector pin 54 is of a female type, including flexible members 56 and mating ends 50 separated by a space 52. Connector pin 54 is shown in a non-distorted condition, where flexible members 56 and mating ends 50 of connector pin 54 are in alignment with axis 58 of connector pin 54, as required for proper assembly of connector pin 54 with a mating male connector pin, which may be, for example, a connector pin of the configuration shown in FIG. 3A.

Flexible members 56 may become distorted and out of alignment from axis 58 of connector pin 54 as the result of improper alignment or interference during assembly of connector pin 54 with a mating male connector pin, for example during insertion over the tangs 36 of connector pin 34 shown in FIG. 3A, upon repeated disconnection and connection of connector pin 54 from a mating connector pin, for example during insertion over tangs 36 of connector pin 34 shown in FIG. 3A or, by example, due to handling damage or distortion during assembly into a connector housing. The distortion is of sufficient magnitude to prevent proper mating assembly of female connector pin 54 with a matable male connector pin, thereby preventing the making of a proper electrical connection.

Figure 4B:
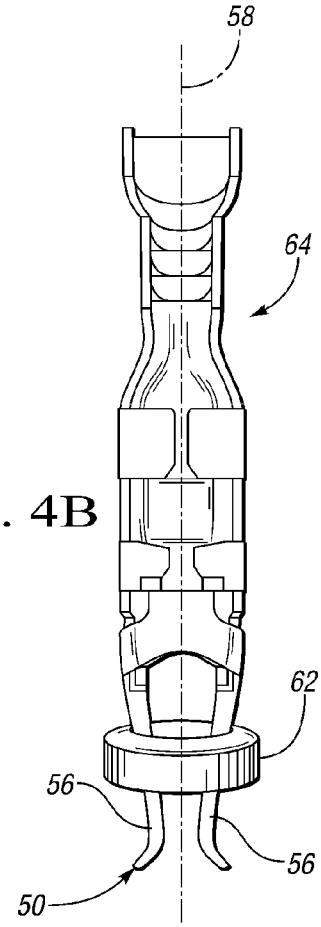
FIG. 4B is a partially sectioned illustration of the connector pin of FIG. 4A with a conforming element.

Referring to FIG. 4B, conforming element 62 may be configured as a generally annular shaped element, in contact with the exterior surfaces of flexible member 56. Other configurations of conforming element 62 may also be used, for example, a semi-circular ring or generally clip-shaped element, as best suited to the mating application, to be positioned in sufficient contact with connector pin 54 so as to constrain, provide support to and prevent distortion and/or plastic deformation of flexible members 56 and mating ends 50 of connector pin 54.

As discussed for the conforming element 22 in the embodiment shown in FIG. 2C, conforming element 62 may be made of a conforming material providing the desired supportive and functional properties, for example, elastomeric materials, plastic, epoxy based materials and rubber or rubber based materials. Conforming element 62 may be incorporated in connector pin 54 during the fabrication of connector pin 54, to form a connector pin assembly 64. Alternatively, conforming element 62 may be incorporated in the connector pin after the connector pin 54 has been fabricated, by assembly on the exterior surface of connector pin 54, as a repair method or durability enhancement feature.

Also discussed previously, conforming element 62 may be adhered to connector pin 54 with an adhesive (not shown) to improve retention of conforming element 62 in proper position for conforming element 62 to provide support to flexible members 56 and mating ends 50. The adhesive may be applied, for example, between the portions of the internal surface of conforming element 62 and the external surfaces of flexible members 56, in the areas where the conforming element 62 contact the external surfaces of flexible members 56. The adhesive may also contribute to provide support to the flexible members 56 and mating ends 50 to prevent distortion thereof. The adhesive may be, by example, of a silicone or epoxy type, or similar material known to those skilled in the art.

While the best modes for carrying out the invention have been described in detail, those familiar with the art to which this invention relates will recognize various alternative designs and embodiments for practicing the invention within the scope of the appended claims.

The invention claimed is:

1. An electrical connector comprising:

a connector pin having a matable end including a flexible member;

a conforming element; and an adhesive;

wherein the conforming element and the adhesive are positioned in contact with and operatively adhered to the flexible member of the matable end of the connector pin so as to prevent distortion of the matable end.

2. The electrical connector of claim 1, wherein the conforming element is comprised of at least one of an elastomeric or epoxy based material.

3. The electrical connector of claim 1, wherein the conforming element is comprised of a rubber based material.

4. The electrical connector of claim 1, wherein the adhesive is one of a silicone adhesive and an epoxy type adhesive.

5. The electrical connector of claim 1, wherein the conforming element has one of a rectangular, triangular, hexagonal, polygonal, wedge, cylindrical, conical and annular shape.

6. The electrical connector of claim 1, further comprising:

a connector housing in combination with at least one connector pin to form a connector assembly.

7. The electrical connector of claim 1, wherein the matable end of the connector pin is of a male type.

8. The electrical connector of claim 1, wherein the matable end of the connector pin is of a female type.

9. An electrical connector assembly comprising:

a connector housing;

at least one connector pin, the connector pin having a matable end including a flexible member; and at least one conforming element; and an adhesive;

wherein the at least one conforming element is configured and positioned in contact with the flexible member of the at least one connector pin so as to prevent distortion of the matable end; and wherein said at least one conforming element is operatively adhered to the flexible member of the matable end of the connector pin with the adhesive.

10. The electrical connector assembly of claim 9, wherein the at least one conforming element is comprised of at least one of an elastomeric, an epoxy based, and a rubber based material.

11. The electrical connector assembly of claim 9, wherein the adhesive is one of a silicone adhesive and an epoxy type adhesive.

12. The electrical connector assembly of claim 9, wherein the conforming element has one of a rectangular, wedge, cylindrical, conical and annular shape.

13. The electrical connector assembly of claim 9, wherein the matable end of the connector pin is of a male type.

14. The electrical connector assembly of claim 9, wherein the matable end of the connector pin is of a female type.

15. A method to prevent distortion of a matable end of an electrical connector, the method comprising:

configuring and positioning a conforming element in contact with a flexible member of the matable end of the connector and fixedly attaching the conforming element to the flexible member using an adhesive so as to prevent distortion of the matable end.

16. The method of claim 15, wherein the adhesive is one of a silicone adhesive and an epoxy type adhesive.

17. The method of claim 15, wherein positioning the conforming element for sufficient contact with the matable end includes one of inserting or injecting the conforming element into or around the matable end to form an assembly of the conforming element with the matable end.

18. The method of claim 15, wherein configuring the conforming element is from one of an elastomeric, epoxy based, and rubber based material.

19. The method of claim 15, wherein configuring the conforming element is in one of a rectangular, triangular, hexagonal, polygonal, wedge, cylindrical, conical and annular shape.

20. The method of claim 15, further comprising:

repairing an electrical connector, wherein repairing the electrical connector includes configuring a conforming element in accordance with the method.

* * * * *